US006050045A

United States Patent [19]

Campbell

[11] Patent Number: 6,050,045

[45] Date of Patent: Apr. 18, 2000

[54] FRAMING SYSTEM FOR BUILDING CONSTRUCTION

[76] Inventor: Ronald W. Campbell, 953 Habgood Street, White Rock, British Columbia, Canada, V4B 4W8

[21] Appl. No.: 09/056,892

[22] Filed: Apr. 6, 1998

Related U.S. Application Data

[63] Continuation-in-part of application No. PCT/CA97/00637, Sep. 5, 1997, which is a continuation-in-part of application No. 08/729,697, Oct. 7, 1996, Pat. No. 5,735,100.

[51] Int. Cl.[7] ..... F04C 3/04; F04B 1/343

[52] U.S. Cl. ..... 52/645; 52/126.6; 52/481.2; 52/646; 52/656.1; 52/690; 52/745.1; 52/745.11; 52/745.14; 52/90.1; 52/DIG. 4

[58] Field of Search ..... 52/645, 126.6, 52/481.2, 656.1, 690, 745.11, 745.14, DIG. 4, 67, 90.1, 646, 745.1

[56] References Cited

U.S. PATENT DOCUMENTS

| | | |
|---|---|---|
| 2,058,386 | 10/1936 | Parsons . |
| 2,357,819 | 9/1944 | Greer . |
| 3,033,330 | 5/1962 | Fowles et al. . |
| 3,078,968 | 2/1963 | Frick . |
| 3,111,202 | 11/1963 | Costello . |
| 3,195,191 | 7/1965 | Neisewander . |
| 3,292,328 | 12/1966 | Lewis et al. . |
| 3,494,405 | 2/1970 | Sandahl et al. . |
| 3,583,466 | 6/1971 | Dreyer . |
| 3,596,701 | 8/1971 | Cowan . |
| 3,823,523 | 7/1974 | Wells . |
| 3,897,668 | 8/1975 | McDonnell . |
| 3,986,312 | 10/1976 | Calhoun et al. . |
| 4,471,548 | 9/1984 | Goudie . |
| 4,516,620 | 5/1985 | Mulhern . |
| 4,546,591 | 10/1985 | Beltz . |
| 4,612,848 | 9/1986 | Pollack . |
| 4,708,189 | 11/1987 | Ward . |
| 5,471,805 | 12/1995 | Becker . |
| 5,487,402 | 1/1996 | Clary . |
| 5,735,100 | 4/1998 | Campbell . |

FOREIGN PATENT DOCUMENTS

| | | |
|---|---|---|
| 502778 | 8/1979 | Australia . |
| 44 28 979 A 1 | 2/1996 | Germany . |
| 4428979 | 2/1996 | Germany . |

*Primary Examiner*—Christopher T. Kent
*Attorney, Agent, or Firm*—Seed & Berry, L.L.P.

[57] ABSTRACT

A system for framing houses or other buildings which uses pre fabricated steel framing and which is quick and easy to construct. A prefabricated system is provided for framing complete building, on a foundation. Folding telescopic framing units are used for vertical partitions and horizontal floor panels. A prefabricated system of framing units is provided for constructing a building comprising: a) providing a foundation; b) securing vertical beams having open upper ends to the foundation at spaced locations; c) securing horizontal beams between the upper ends of the vertical beams; d) erecting and securing folding, telescopic floor joists on the foundation; and e) erecting and securing folding, telescopic roof trusts at spaced locations on the horizontal beams. Also provided is a framed building comprising: a) a foundation; b) vertical beams having open upper ends secured to the foundation at spaced locations; c) horizontal beams secured between the upper ends of the vertical beams; d) erected folding, telescopic floor joists secured on the foundation; and e) erected folding, telescopic roof trusts secured at spaced locations on the horizontal beams.

16 Claims, 11 Drawing Sheets

FRAMING SYSTEM FOR BUILDING CONSTRUCTION

CROSS-REFERENCE TO RELATED APPLICATIONS

This application is a continuation-in-part of International application No. PCT/CA97/00637 filed Sep. 5, 1997, which is a continuation-in-part of application No. 08/729,697 filed Oct. 7, 1996, now U.S. Pat. No. 5,735,100.

TECHNICAL FIELD

The invention relates to the field of building construction and in particular to prefabricated framing units for constructing interior and exterior walls, floors and roofs, some of which are telescopic and fold for easy shipment and installation.

BACKGROUND ART

According to existing methods of frame building construction, a concrete foundation is formed on which wooden floor joists are laid. Walls are constructed on the foundation and floor using wooden wall studs, and a roof is constructed on the walls using wooden rafters, beams and trusses. These methods require skilled carpenters and high quality wood materials, both of which are increasingly expensive. There is therefore a need for a system for framing houses or other buildings which uses prefabricated steel framing and which is quick and easy to construct.

DISCLOSURE OF INVENTION

The invention provides a prefabricated system for framing a complete building on a foundation. Folding telescopic framing units are used for vertical partitions and horizontal floor panels.

The invention therefore provides a prefabricated system of framing units for constructing a building comprising:

a) providing a foundation;

b) securing vertical beams having open upper ends to the foundation at spaced locations;

c) securing horizontal beams between the upper ends of the vertical beams;

d) erecting and securing folding, telescopic floor joists on the foundation; and c) erecting and securing folding, telescopic roof trusts at spaced locations on the horizontal beams.

The invention also provides a method of framing a building comprising:

a) a foundation;

b) vertical beams having open upper ends secured to the foundation at spaced locations;

c) horizontal beams secured between the upper ends of the vertical beams;

d) erected folding, telescopic floor joists secured on the foundation; and e) erected folding, telescopic roof trusts secured at spaced locations on the horizontal beams.

BRIEF DESCRIPTION OF DRAWINGS

In drawings which illustrate a preferred embodiment of the invention.

BEST MODE(S) FOR CARRYING OUT THE INVENTION

Figure 15:
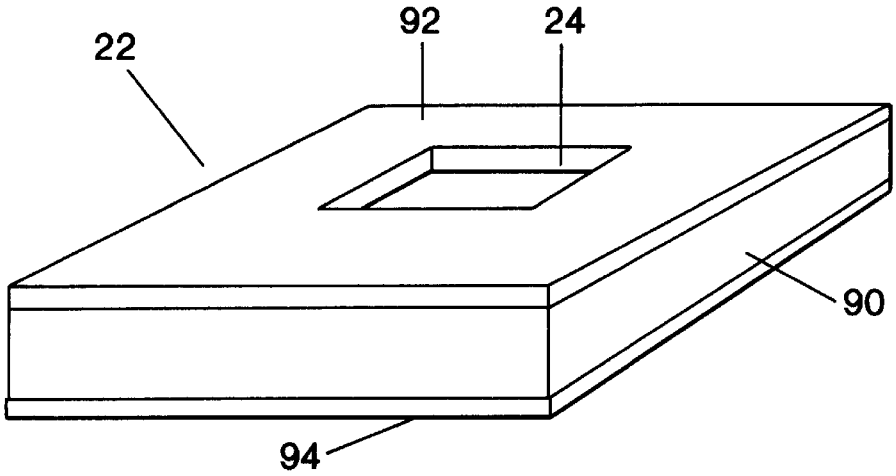
FIG. 15 is a detail of a window wall module.

With reference to the accompanying drawings (not to scale), which illustrate the invention by a simplified structure having a smaller number of components than would be the case in an actual construction, and with certain components not in place for ease of illustration, a prefabricated framing system 10 is shown constructed on concrete foundation 12. Alternatively, vertical foundation piers (not shown), whether concrete or steel, may be used instead of a concrete foundation, with horizontal foundation beams secured to their upper ends to form a foundation for the structure. Secured at the lower ends thereof to concrete foundation 12 at regular intervals are hollow, vertical steel posts 16, shown in more detail in FIG. 5. Secured to the top of posts 16 are horizontal steel beams 18, also as shown in more detail in FIG. 5. Steel floor joists 52, described in further detail below, are secured to foundation 12 between posts 16. Posts 16, floor joists 52 and beams 18 thus form rectangular openings 20 which can receive wall modules 22. Wall module 22 shown in FIG. 1 has a small window 24 formed in a sandwich 21 of coated drywall, foam insulation and finished particle board by way of example. A variety of such pre-finished materials can be used for the interior and exterior surfaces. Wall module 22 shown in FIG. 1A has a door opening 28 formed between slabs of foam insulation 29 and a reinforcement base 30. A suitable material, for example would be a laminates of a finished drywall interior, rigid foam insulation and a finished particle board exterior layer. A mesh exterior surface may be provided to permit the application of an exterior stucco surface. Outside gable end sill plates 13 fill in the space between the beams 16 at the ends of the unit. Module 22 is shown in isolation in FIG. 15 with foam core 90 to which are bonded pre-finished interior and exterior panels 92, 94. Ceiling panels are constructed in a similar manner.

Figure 2:
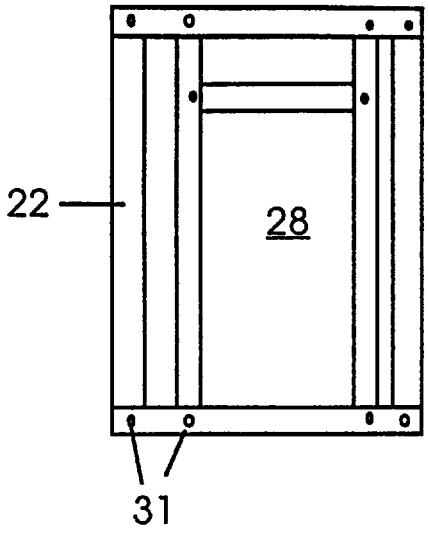
FIG. 2 is an elevation view of a first module for use with the framing unit shown in FIG. 1.
Figure 3:
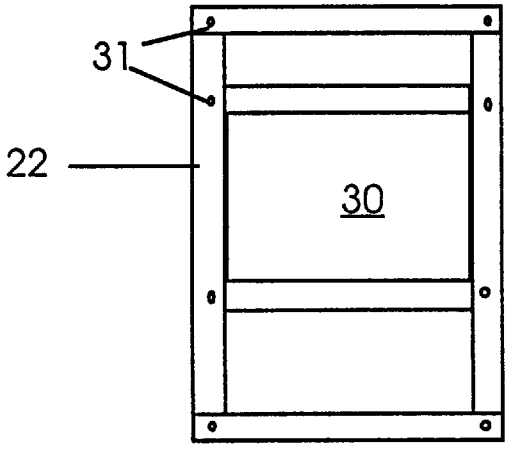
FIG. 3 is an elevation view of a second module for use with the framing unit shown in FIG. 1.
Figure 4:
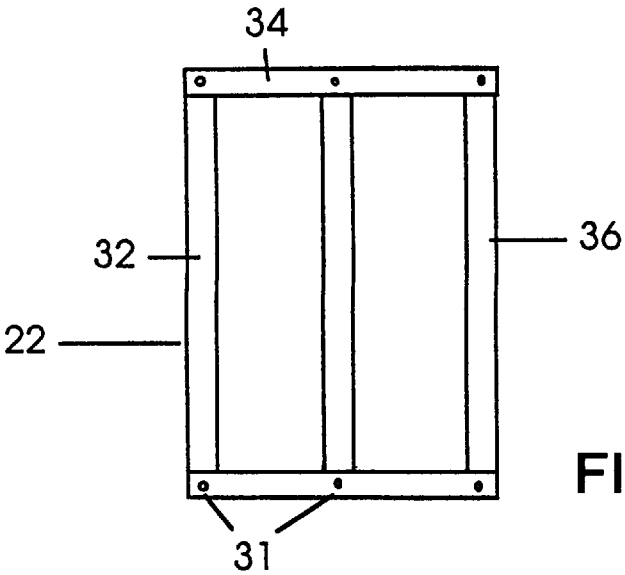
FIG. 4 is an elevation view of a third module for use with the framing unit shown in FIG. 1.

Various modules 22 for use with the system are shown in FIG. 2–4, namely a door opening 28, a large window opening 30, and a standard framing section 32. Each module 22 is adapted to be folded about hinges 31 and to fit within space 20 when the post and beam frames are constructed. On site, the different modules are interchangeable to custom design a particular house or building. Each module is designed to fit a standard space, such as 4'×8'. The modules can be pre-fabricated with insulation, wiring etc. to save time on construction. Studs 36 can be hingedly connected to the horizontal members 34 at hinges 31 by metal screws or systems like TOGGLE LOCKS™. Steel members 34 and 36 are preferably 28 gauge galvanized steel channel, either C-shaped channels or tubular elements which are rectangular in cross-section for vertical studs 36.

Figure 11:
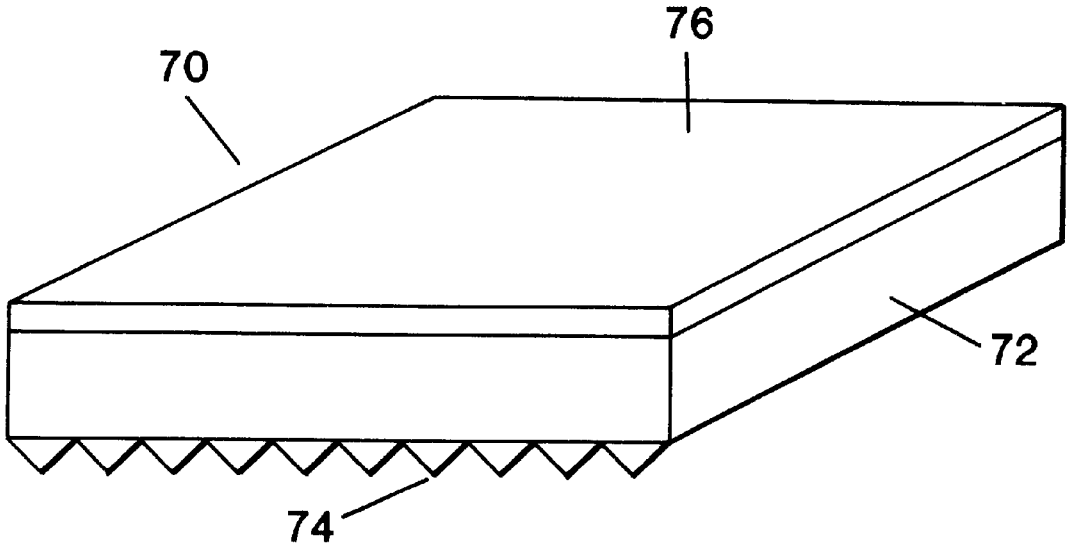
FIG. 11 is a perspective view of a floor panel unit.
Figure 12:
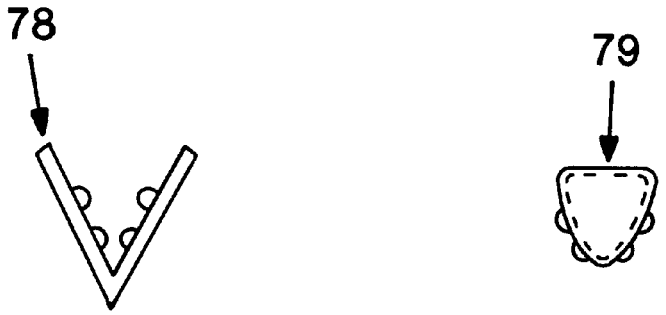
FIG. 12 is a schematic view of the V-clip for the floor panel unit shown in FIG. 11.

Roof 25 is secured to beams 18 by means of roof trusses 26, shown in further detail in FIG. 11 and 12. Steel Z-bars 27 are secured to roof trusses 26 in parallel fashion and corrugated steel roof panels (not shown) are secured to Z-bars 27 to form the roof.

Figure 5:
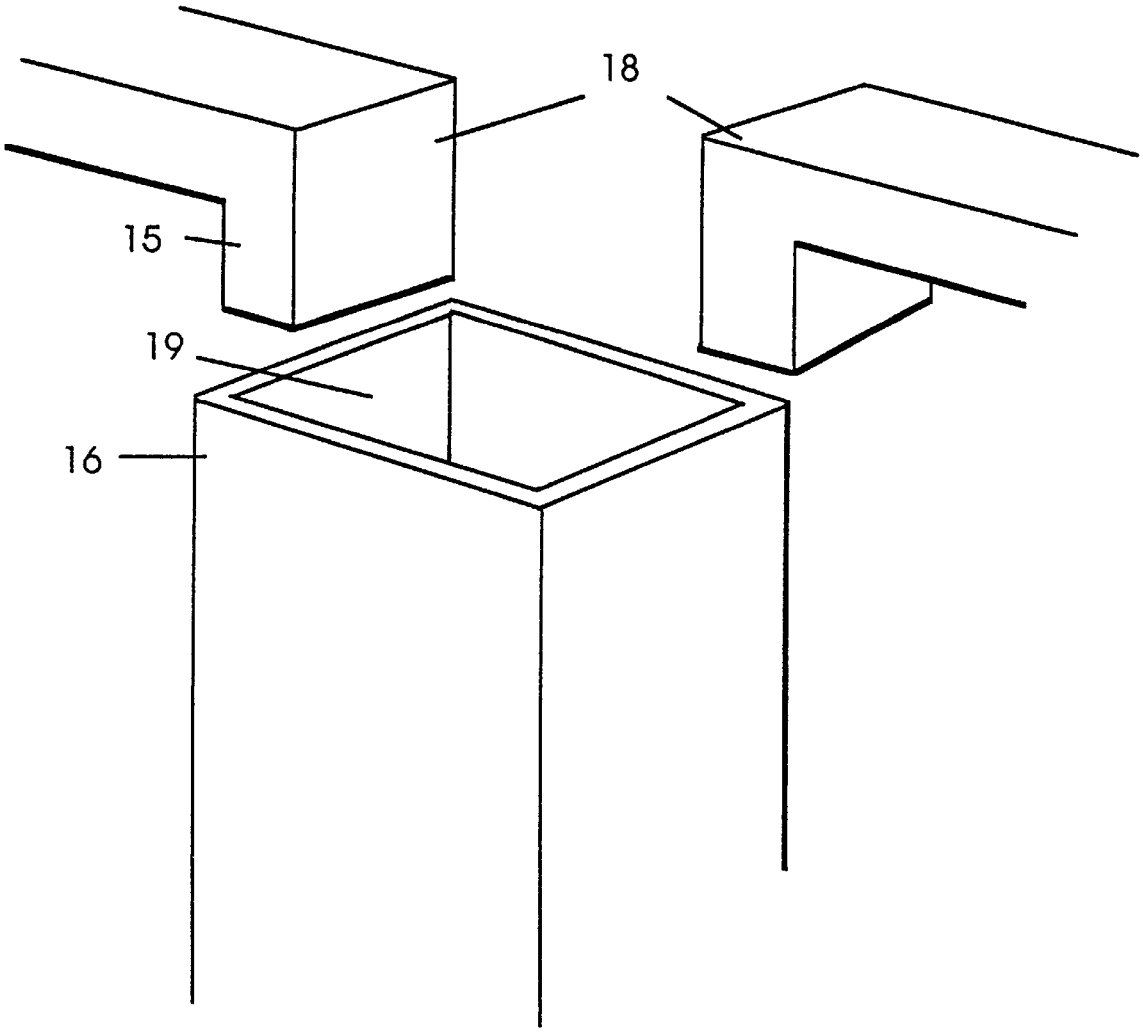
FIG. 5 is a perspective view of two beams in conjunction with a post as shown in FIG. 1.

As shown in FIG. 5, the ends of steel beams 18 have perpendicular, downward extensions 15 sized to extend snugly into the upper opening 19 in hollow, vertical steel posts 16 where they can be bolted securely in place. Steel beams 18 are hollow light gauge steel. To form a corner, corner posts 16 are utilized which can receive the beams 18 at right angles, with the extensions 15 being received in the upper open end of compartment 16B. This is achieved, as shown in FIG. 6, by providing side compartments 16*b* at right angles to each other, and attached to the central compartment 16*a*.

Figure 6:
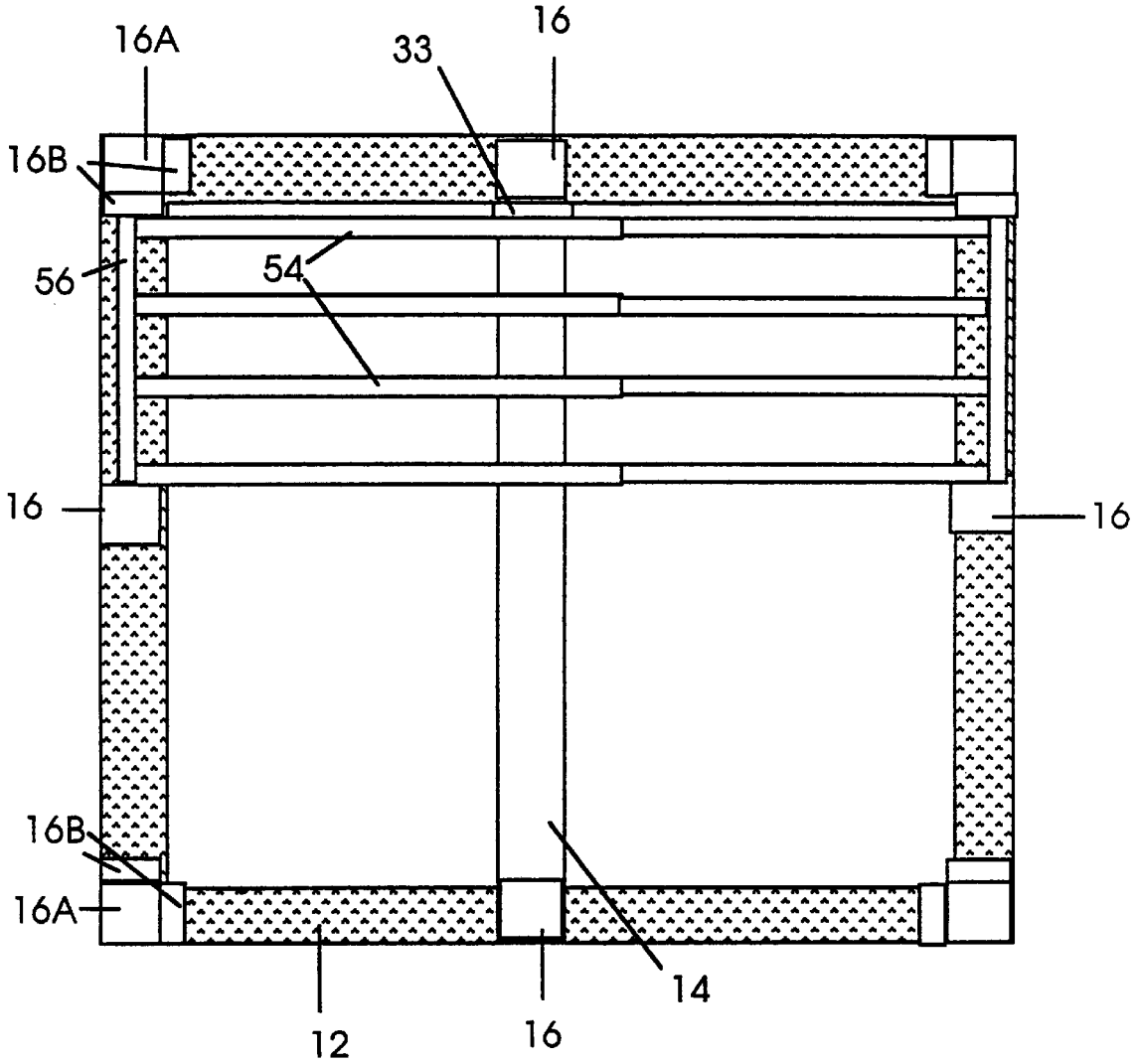
FIG. 6 is a cross-section view taken on line 6—6 of FIG. 1.
Figure 7:
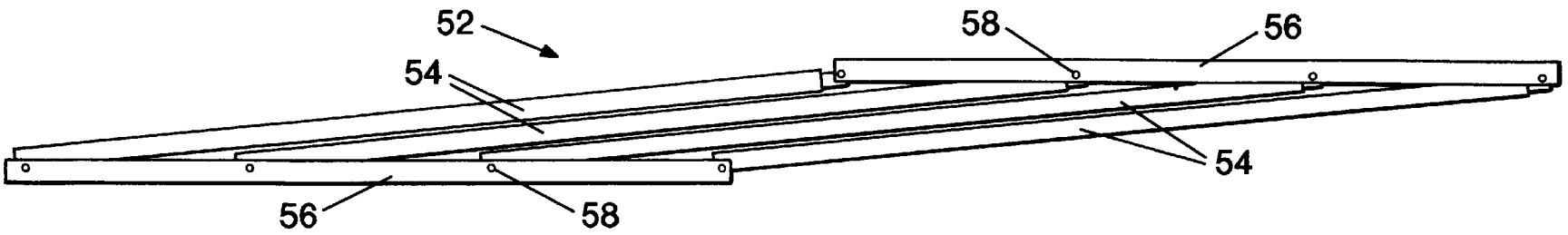
FIG. 7 is a top view of a floor joist framing unit according to the invention in collapsed condition.
Figure 8:
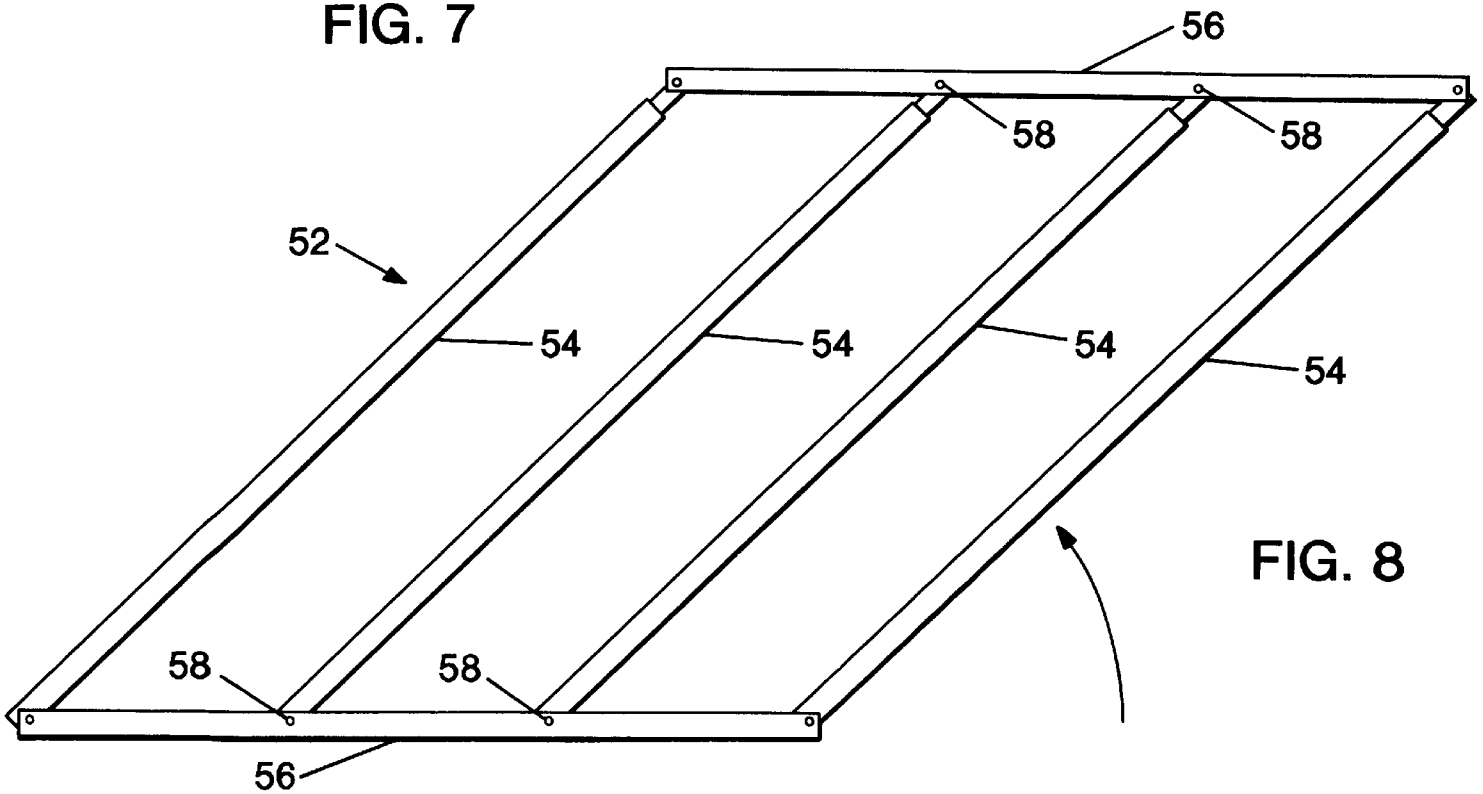
FIG. 8 is a top view of the floor joist framing unit shown in FIG. 7 in partly raised condition.
Figure 9:
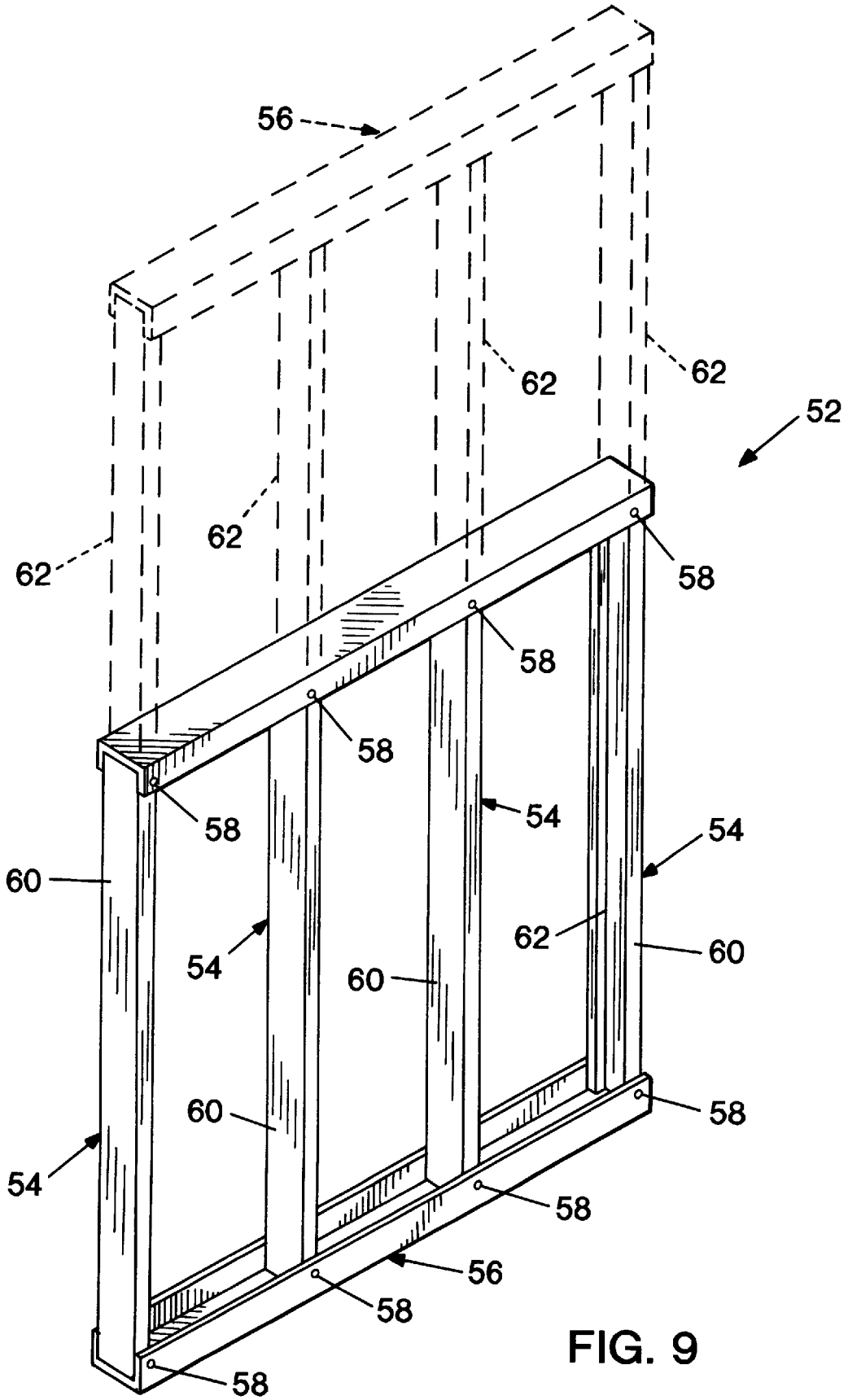
FIG. 9 is a perspective view of the floor joist framing unit shown in FIG. 7 in raised position, with the extended condition shown in phantom outline.
Figure 10:
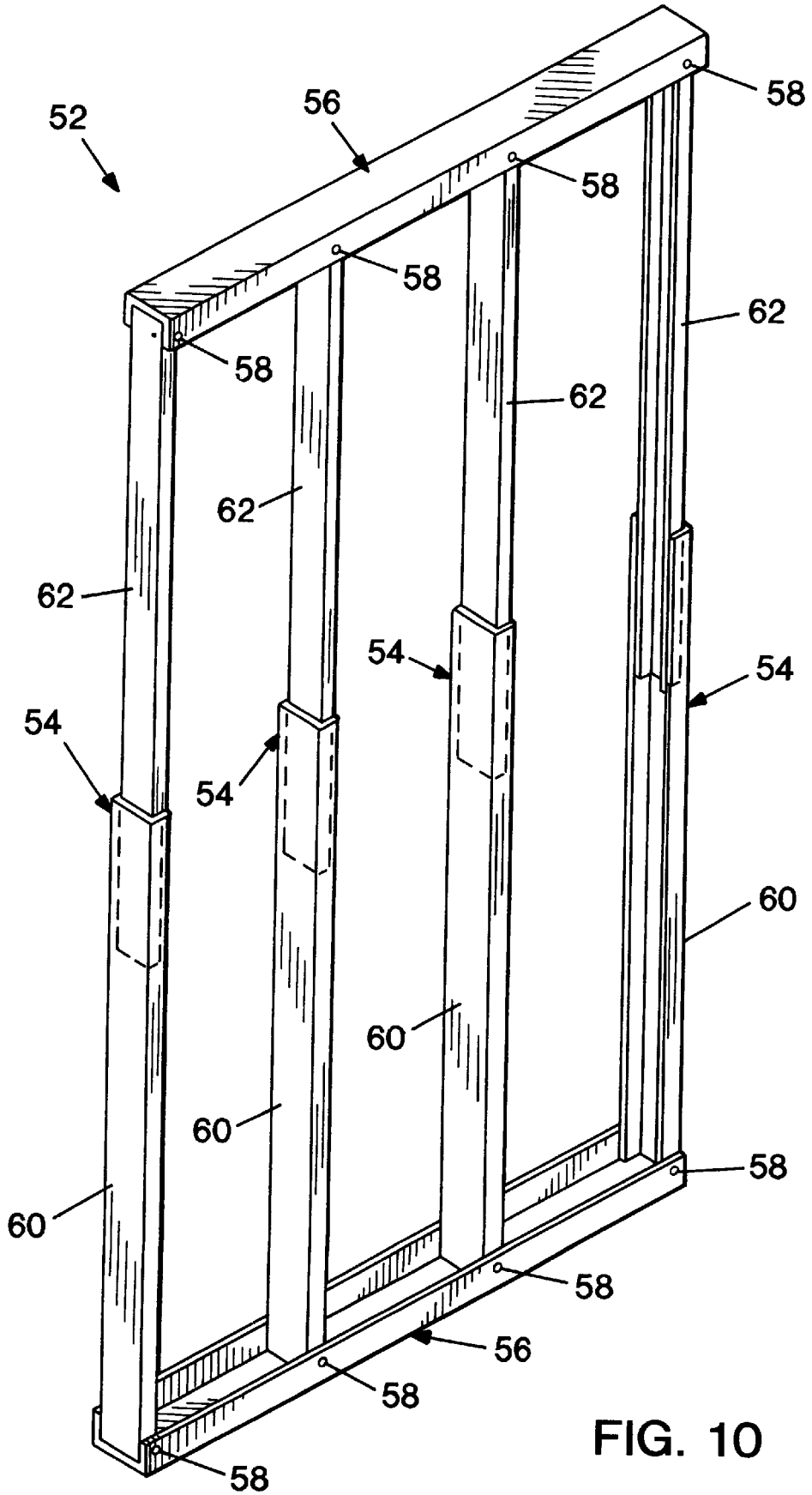
FIG. 10 is a perspective view of the floor joist framing unit shown in FIG. 7 in raised and extended position.

FIG. 6 illustrates the construction of a floor according to the invention. Horizontal beam 14 is secured on foundation 12 to support folding, telescopic floor joists, with a post 16 bearing on beam 14 at either end thereof. Folding, telescopic floor joist frame panels 52, shown in further detail in FIG. 7–10 extend from one side of the foundation to the other between posts 16. Each floor joist frame panel 52 comprises transverse members 54 and parallel members 56. A standard floor joist framing unit 52 is designed to support 8 foot by 4 foot pieces of floor sheeting, for example, so preferably when fully unfolded and extended is 7 foot 9–½ inches wide (to sit between compartments 16*b* and post 16) and multiples of 8 feet long, with the overlap sections of outer and inner members 60, 62 supported on beam 14. Liner pieces 33 space the floor joist framing unit 52 from beam 16. Members 54 are hingedly connected to the members 56 at hinges 58, which typically are metal screws or TOGGLE LOCKS™. Members 56 are preferably galvanized steel channel. Transverse members 54 comprise outer members 60 and inner members 62 as shown in FIG. 10, which can be either C-shaped channels as shown or tubular elements which are rectangular in cross-section. The inner members 62 to slide freely within outer members 60 to permit extension and retraction of the studs. Members 56 are screwed to foundation 12 once in place and the overlapping section of members 54 are screwed to beam 14. Alternatively members 54 can be pre-drilled to receive bolts (not shown) which are pre-installed in beam 14 to fasten members 54 to beam 14 using nuts, to expedite the installation process.

FIG. 11 illustrates a floor panel 70, typically 4' by 8', which is installed on floor joist panels 52. Each panel 70 has a central layer 72 of rigid foam insulation, a bottom layer 74 of corrugated metal such as galvanized steel to prevent access by insects or pests, and a finished upper surface 76 of linoleum, hardwood tiles or the like. The foam 72 extends into the ridges formed by the corrugated metal 74. Panels 70 are removably installed on the upper surface of floor joist panels 52 by way of clips, for example. For example, V-shaped channels 78 shown in FIG. 12 can be provided in members 54 to receive a protrusion 79 from the underside 74 of panels 70 at spaced locations which are wedged into the V-shaped channels. Similar pre-fabricated ceiling panels can also be installed to the underside of a second level of floor joist panels.

Figure 13:
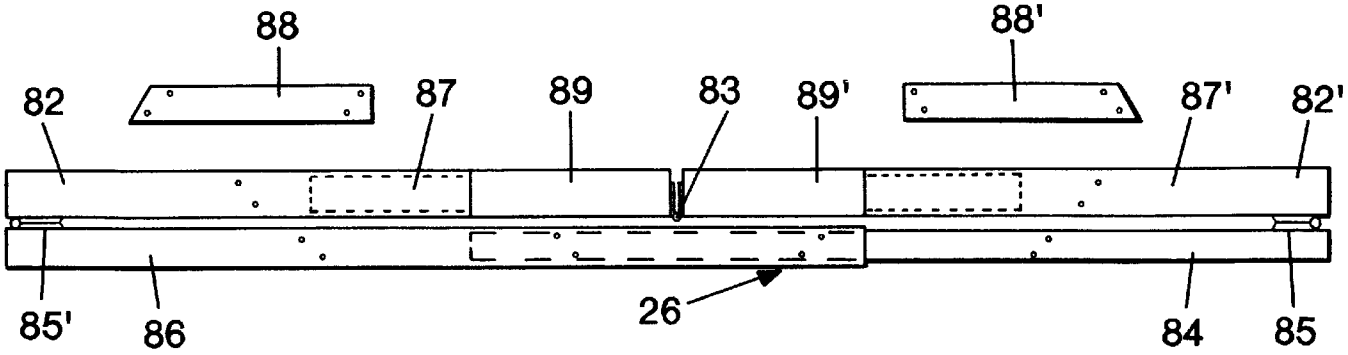
FIG. 13 is an elevation view of a collapsible roof truss framing unit according to the invention in collapsed condition.
Figure 14:
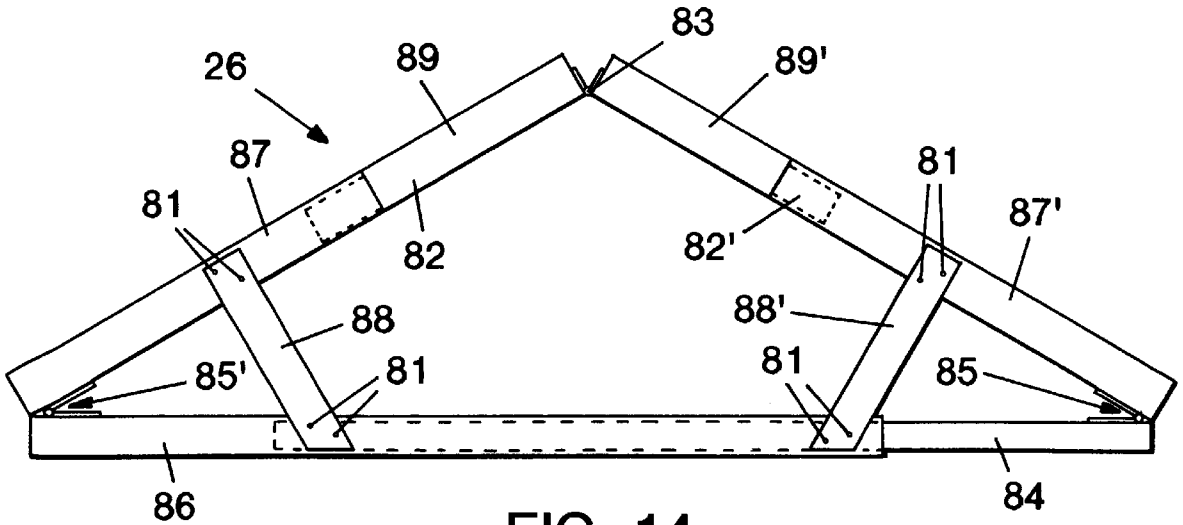
FIG. 14 is an elevation view of the collapsible roof truss framing unit shown in FIG. 11 in raised condition.

FIG. 13 and 14 illustrate the pre-fabricated, folding telescopic roof truss 26 to be used as a load-supporting roof or loft truss. A roof truss 26, shown in FIG. 13, 14 comprises peak elements 82, 82' joined by hinge 83, and inner and outer cross-members 84, 86 joined to peak members 82', 82 by hinges 85, 87 respectively. Inner cross-member 84 telescopes within outer cross-member 86. Peak members 82', 82 are comprised of elements 87, 89 and 87', 89' wherein 89 and 89' have ends which telescope freely within elements 87, 87'. To erect the roof truss, the peak members 82, 82' are raised, causing inner cross-member 84 to slide inside cross-member 86 and the ends of 89 and 89' to slide within elements 87, 87'. Reinforcing members 88, 88' are then screwed by means of screws 81 to the respective beams as shown to secure the truss.

Interior non-load-bearing walls can also be framed using the inventor's prefabricated folding telescopic framing unit for non-loadbearing walls disclosed in U.S. patent application Ser. No. 08/729,697 which is incorporated herein by reference. Studs 36 are hingedly connected to the horizontal members 34 at hinges 38, which typically are metal screws or TOGGLE LOCKS™. Horizontal members 34 can be, for example, galvanized steel channel, either C-shaped channels or tubular elements which are rectangular in cross-section. Pre-punched service openings 44 may be provided in various stud members for purposes of wiring and plumbing.

To frame a building using the invention, the various framing units are manufactured off-site and shipped to the site in collapsed condition where possible. The vertical posts 16 and corner posts 15 are secured in place to foundation 12, as are transverse horizontal beams 14. The floor joist panels 52 are then installed by laying the parallel members 56 in position on the foundation 12. The opposite member 56 is grasped and unfolded to the position shown in FIG. 9 with transverse members 54 aligned in parallel. One parallel member 56 is fastened in position on the foundation 12 with screws, toggle lock, nails or the like. The opposite parallel member 56 is grasped and extended to the position shown in FIG. 10, causing the inner members 62 to slide out from outer members 60, until the opposite member 56 meets the beam 50. The opposite member 56 is then fastened in position to the opposite side of foundation 12. The outer and inner members 60, 62 are then fastened by screws, toggle locks or the like to horizontal beam 14 in the overlap area. The desired floor panelling can then be attached to the framing unit to complete the floor, by fastening with screws etc. or clips such as the a V-notch arrangement described above.

Figure 1:
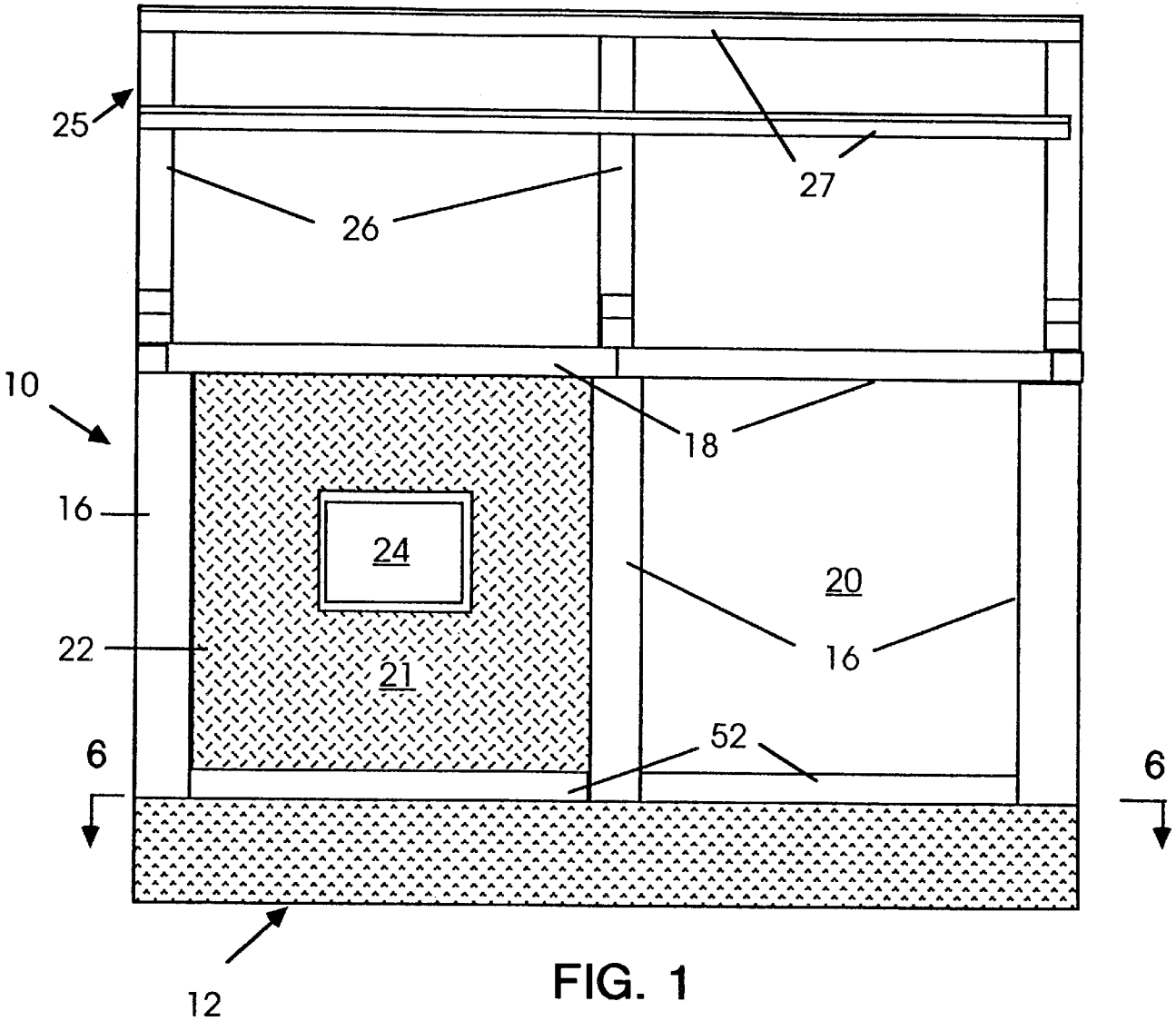
FIG. 1 is a side elevation view of a framing system unit according to the invention.
Figure 1A:
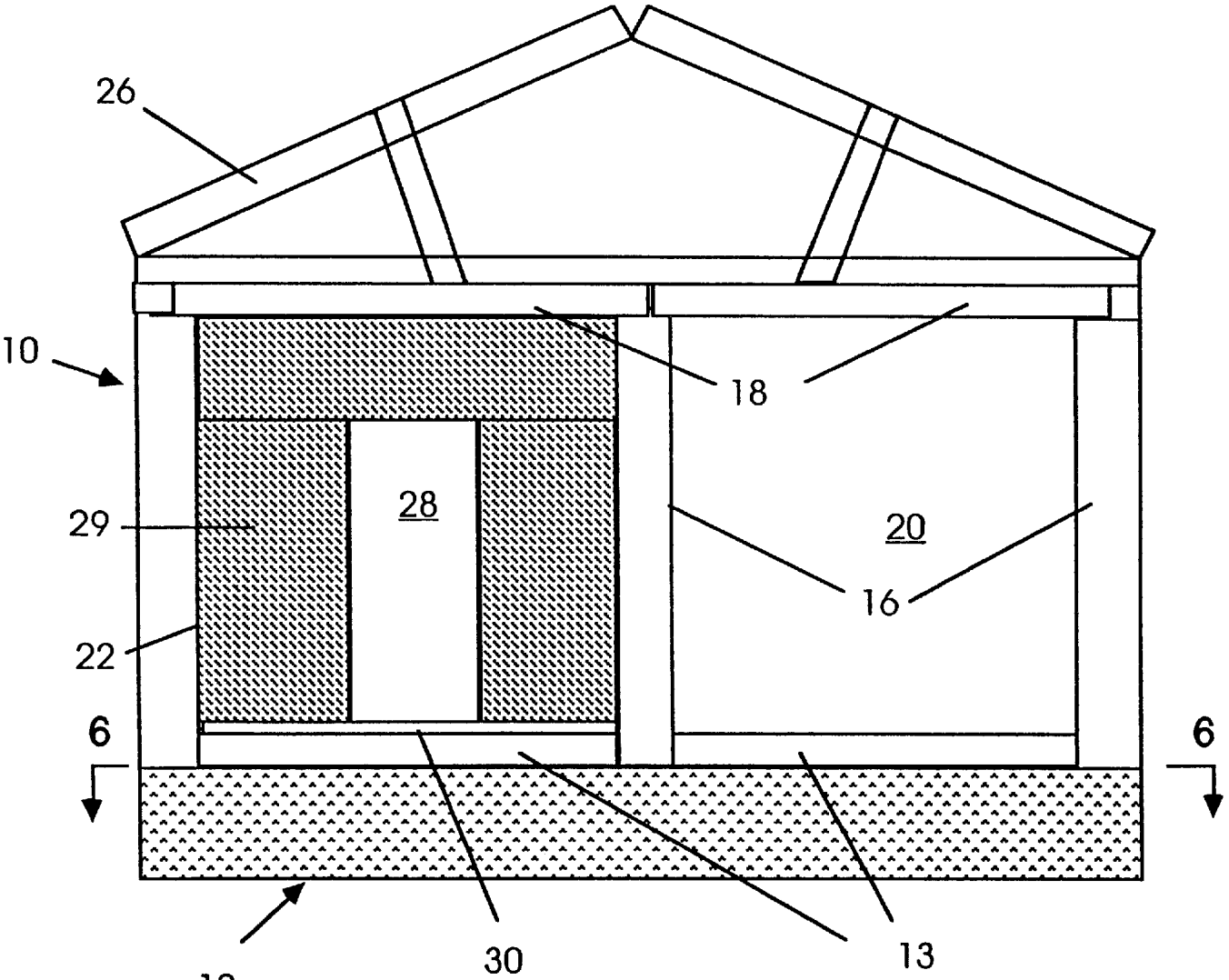
FIG. 1A is an end elevation view of a framing system unit according to the invention.

The load-supporting floor joist system requires a sufficiently heavy gauge steel to support loads, typically 18 to 20 gauge. The necessary type and thickness of steel will be apparent to those skilled in the art. The size of the floor joist framing units may be typically 7' 9½" wide by 16, 24 or 32 feet long. The vertical exterior walls are constructed as follows. Beams 18 are secured to the posts 16 through extensions 15 by bolts, screws etc. The location for the different wall modules 22 is selected and each is installed according to the type of module. If a framing module as shown in FIG. 2–4 is used, then the required exterior and interior panelling can then be attached to the framing unit to complete the wall. Roof trusses 26 are then erected as described above and fastened to beams 18 at intervals as shown in FIG. 1. Z-bars 27 are fastened to roof trusses 27 and roofing panels (not shown) are secured to the Z-bars to form the roof.

Various related elements as disclosed in International application no. PCT/CA97/00637, which is incorporated herein by reference, can be used to add to the usefulness of the present invention. For example, a related folding, telescopic header unit facilitates the framing of door or window units. A single telescopic stud can be used in conjunction with the invention. When a partition wall being constructed requires a framing unit which is less than a standard length, a single telescopic stud can be installed at the required length. Similarly a single stud can be installed at a location in a framing unit to frame a door or the like.

As will be apparent to those skilled in the art in the light of the foregoing disclosure, many alterations and modifications are possible in the practice of this invention without departing from the spirit or scope thereof. For example, different cross-section shapes and different sizes can be selected for the various beams and studs, and different materials are suitable for the components. Accordingly, the scope of the invention is to be construed in accordance with the substance defined by the following claims.

What is claimed is:

1. A method of framing a structure comprising:

a) providing a foundation;

b) securing vertical beams having open upper ends to said foundation at spaced locations;

c) securing horizontal beams between the upper ends of said vertical beams;

d) erecting and securing folding, telescopic floor joists on said foundation; and e) erecting and securing folding, telescopic roof trusses at spaced locations on said horizontal beams.

2. The method of claim 1 further comprising securing pre-fabricated floor panels to said erected and secured floor joists.

3. The method of claim 1 further comprising securing pre-fabricated roof panels to said erected and secured roof trusses.

4. The method of claim 1 further comprising securing pre-fabricated wall modules in the spaces formed by said vertical and horizontal beams and said floor joists.

5. The method of claim 4 wherein said pre-fabricated wall modules comprise a window module.

6. The method of claim 4 wherein said pre-fabricated wall modules comprise a framing module.

7. The method of claim 4 wherein said pre-fabricated wall modules comprise a door module.

8. The method of claim 1 wherein said horizontal beams have downwardly extending ends to engage said open upper ends of said vertical beams.

9. A framed building comprising:

a) a foundation;

b) vertical beams having open upper ends secured to said foundation at spaced locations;

c) horizontal beams secured between the upper ends of said vertical beams;

d) erected folding, telescopic floor joists secured on said foundation; and e) erected folding, telescopic roof trusses secured at spaced locations on said horizontal beams.

10. The framed building of claim 9 further comprising pre-fabricated floor panels secured to said erected and secured floor joists.

11. The framed building of claim 9 further comprising pre-fabricated roof panels secured to said erected and secured roof trusses.

12. The framed building of claim 9 further comprising pre-fabricated wall modules secured in the spaces formed by said vertical and horizontal beams and said floor joists.

13. The framed building of claim 12 wherein said pre-fabricated wall modules comprise a window module.

14. The framed building of claim 12 wherein said pre-fabricated wall modules comprise a framing module.

15. The framed building of claim 12 wherein said pre-fabricated wall modules comprise a door module.

16. The framed building of claim 12 wherein said horizontal beams have downwardly extending ends to engage said open upper ends of said vertical beams.

* * * * *